US009743713B1

(12) United States Patent
Lam

(10) Patent No.: US 9,743,713 B1
(45) Date of Patent: Aug. 29, 2017

(54) SHOELACE FASTENING DEVICE

(71) Applicant: Cutting Edge Products Company Limited, Hong Kong (HK)

(72) Inventor: Chung Yin Lam, Hong Kong (HK)

(73) Assignee: Cutting Edge Products Company Limited, Hong Kong (HK)

( * ) Notice: Subject to any disclaimer, the term of this patent is extended or adjusted under 35 U.S.C. 154(b) by 0 days.

(21) Appl. No.: 15/213,373

(22) Filed: Jul. 18, 2016

(51) Int. Cl.
*A43C 7/04* (2006.01)
*A43C 11/24* (2006.01)

(52) U.S. Cl.
CPC ..... *A43C 7/04* (2013.01); *A43C 11/24* (2013.01)

(58) Field of Classification Search
CPC ..... A43C 7/04; A43C 7/005; A44B 18/0061
See application file for complete search history.

(56) References Cited

U.S. PATENT DOCUMENTS 4,715,094 A * 12/1987 Herdman ..... A43C 7/005 24/712.3
8,739,373 B1 * 6/2014 Berman ..... A43C 7/04 24/712.6
2003/0070269 A1 * 4/2003 Chung ..... A43C 3/00 24/714.6
2013/0111717 A1 * 5/2013 Rogers ..... A43C 7/005 24/712.3
2014/0020263 A1 * 1/2014 Theuvenet ..... A43B 3/0005 36/50.1
2014/0208551 A1 * 7/2014 Ben-Arie ..... A43C 7/04 24/712.9

* cited by examiner

*Primary Examiner* — David Upchurch
(74) *Attorney, Agent, or Firm* — Wayne & King LLC

(57) ABSTRACT

A shoelace fastening device comprises a first buckle having a first through-hole and a second through-hole separated from the first through-hole. One shoelace of a shoe enters the shoelace fastening device from the first through-hole and extends out of the shoelace fastening device from the second through-hole, while the other shoelace enters the shoelace fastening device from the second through-hole and extends out of the shoelace fastening device from the first through-hole. The shoelace fastening device further includes a second buckle having a first pressing portion adapted to the first through-hole and a second pressing portion adapted to the second through-hole.

9 Claims, 8 Drawing Sheets

SHOELACE FASTENING DEVICE

TECHNICAL FIELD

The present application relates to the technical field of shoes and shoe accessories, and more particularly, relates to a shoelace fastening device.

BACKGROUND OF THE PRESENT INVENTION

Most of the traditional shoes are tight by shoelaces. However, because of various reasons, the shoelaces easily get loosened, which makes it inconvenient for a wearer, especially when it is raining, when the wearer wants to catch the transportation or when the wearer is playing sports in competition.

In the prior art, some fastening devices are developed for fastening the shoelace. For example, one of the fastening devices includes two magnetic couplers. In this case, the shoelaces respectively run through all of the eyelets on the same side of a shell of a shoe, and run through magnetic couplers after that; finally, the shoelaces are fastened due to the magnetic forces between two magnetic couplers. When using this type of fastening device, the magnetic couplers will affect the appearance of the shoe. Besides, it is inconvenient to adjust a tightness of the shoelaces once the shoelaces have been fastened by the fastening device.

In a further case, a fastening device includes a special snapping structure which has a much smaller volume. The snapping structure includes two snapping holes for the shoelaces to run through. This fastening device will not affect the appearance of the shoes. However, it needs to cut off the shoelaces once feet of the wearer enter the shoe compartments, and thus it is quite inconvenient to adjust the tightness of the shoelaces.

SUMMARY OF PRESENT INVENTION

The objective of the present application is to provide a shoelace fastening device, and it is convenient for the wearer to adjust the tightness of the shoelaces when using the shoelace fastening device of the present application.

In accordance with an aspect of the present application, a shoelace fastening device is provided, which comprises a first buckle and a second buckle. The first buckle includes a first through-hole and a second through-hole separated from the first through-hole. One shoelace of a shoe enters the shoelace fastening device from the first through-hole and extends out of the shoelace fastening device from the second through-hole, while the other shoelace enters the shoelace fastening device from the second through-hole and extends out of the shoelace fastening device from the first through-hole. The second buckle is engaged with the first buckle or disengaged from the first buckle. One end of second buckle is pivotably connected to the first buckle. The second buckling has a first pressing portion adapted to the first through-hole and a second pressing portion adapted to the second through-hole.

In one embodiment, the first buckle includes a separating wall used for dividing the first through-hole and the second through-hole into two parts for forming two separated running paths for two shoelaces.

In one embodiment, the first buckle includes a snapping slot is defined on an outer surface at one end of the first buckle that is close to the second through-hole; a snapping hook adapted to the snapping slot is arranged correspondingly on the second buckle.

In one embodiment, the first buckle includes a frame and a mounting plate connected to the frame; the first through-hole and the second through-hole are formed between the frame and the mounting plate.

In one embodiment, a plurality of first projections separated from each other are projected from an inner surface of the mounting plate that is oriented towards the second buckle; a receiving assembly for receiving the plurality of first projections is formed on the inner surface of the second buckle; wherein the receiving assembly includes a plurality of longitudinal ribs and a plurality of transverse ribs intersecting with the plurality of longitudinal ribs; a plurality of receiving compartments for respectively receiving the plurality of projections are formed by the longitudinal ribs and the transverse ribs.

In one embodiment, a plurality of second projections are further projected from the longitudinal ribs or the transverse ribs of the receiving assembly in a direction towards the first buckle.

In one embodiment, the first projections and the second projections are in shape of triangular pyramids.

In one embodiment, a decorative portion is provided on an outer surface of the second buckle.

In one embodiment, two guiding portions are formed on two ends of the mounting plate of the first buckle, and two stressing portion cooperated with the guiding portions are provided on the inner surface of the second buckle; each of the two guiding portions includes a guiding slope and a plurality of guiding teeth connected to the guiding slope; the guiding teeth are inclined in a direction opposite to an inclining direction of the guiding slope.

In one embodiment, a first axis hole is defined at one end of the frame that is close to the first through-hole, and a first pivot shaft adapted to the first axis hole are correspondingly arranged on the second buckle.

In one embodiment, the shoelace fastening device is in shape of a crescent.

When implementing the shoelace fastening of the present application, the following advantageous can be achieved: the adjustment of the tightness of the shoelaces is simple and easy; the shoelace fastening device of the present application can be both used in front of a shoe tongue or behind the shoe tongue, without hurting the feet of the wearer; it is possible to print or engrave brands or patterns on the shoelace fastening device, which will make the appearance of the shoes more attractive, and the shoelace fastening device can be more widely used.

DESCRIPTION OF THE DRAWINGS

The present application will be further described with reference to the accompanying drawings and embodiments in the following, in the accompanying drawings.

DETAILED DESCRIPTION OF PREFERRED EMBODIMENTS

In order to make the technical features, the propose and the technical effect of the present application more clearly, the specific implemental means of the present application will now be described in detail with reference to the accompanying drawings.

Figure 1:
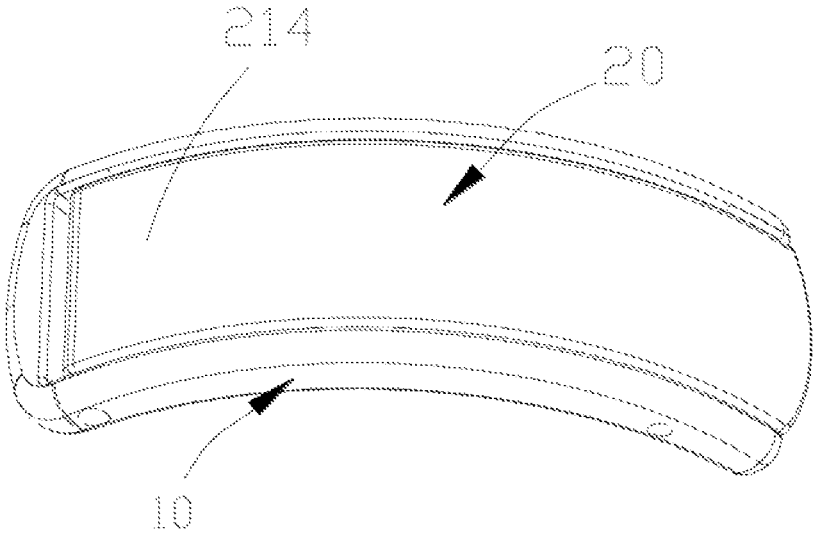
FIG. 1 is a schematic view of a shoelace fastening device according to a preferred embodiment of the present application, wherein the shoelace fastening device is in a close state.
Figure 2:
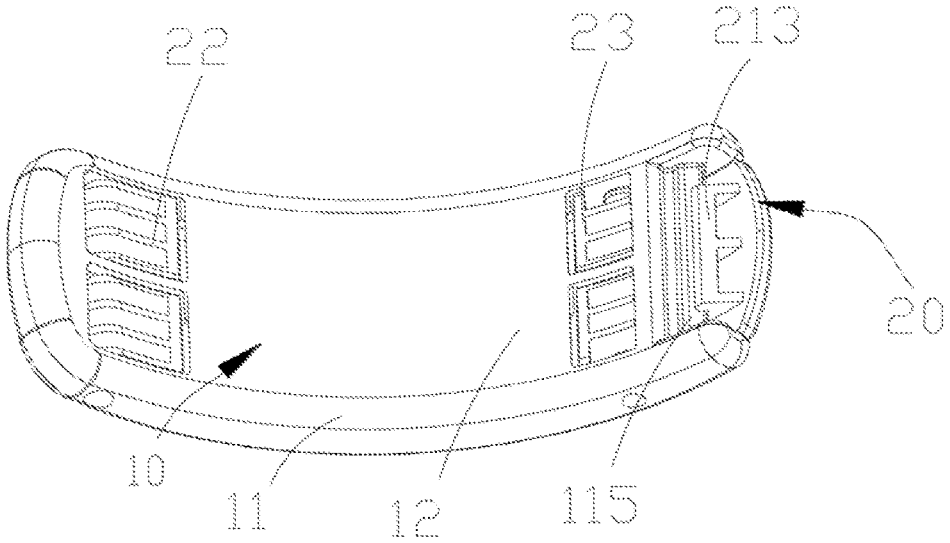
FIG. 2 is a further schematic view of the shoelace fastening device of the present application, wherein the shoelace fastening device is in the close state.

FIGS. 1-2 show a structure of a shoelace fastening device according to a preferred embodiment of the present application. Preferably, is in shape of a crescent. In this case, the shape of the shoelace fastening device is preferably adapted to the shape of an instep of a person. In this way, it is possible to protect feet joints of the person. Furthermore, shoelace fastening device of the present application is a plastic injection product. The shoelace fastening device is preferably made from nylon; thereby, the shoelace fastening device is strong enough and is not easy to be damaged.

Figure 3:
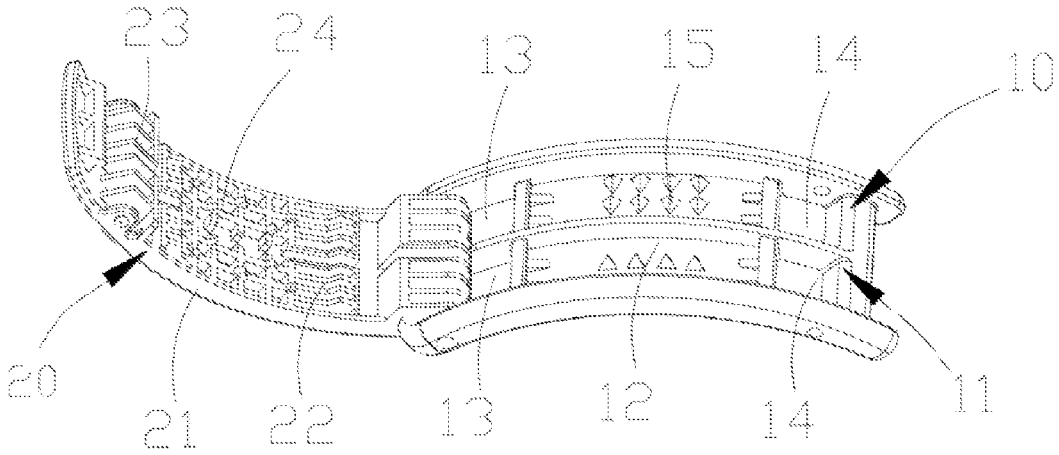
FIG. 3 is a further schematic view of the shoelace fastening device of the present application, wherein the shoelace fastening device is in an open state.

Specifically, as shown in FIGS. 1-3, the shoelace fastening device substantially includes a first buckle 10 and a second buckle 20. One end of the second buckle 20 is pivotably connected to the first buckle 10, and the second buckle 20 may be engaged with the first buckle 10 or disengaged from the first buckle 10 with an external force. In this way, on one hand, the shoelace fastening device may be opened, and the shoelaces may be introduced into the shoelace fastening device; or the tightness of the shoelaces may be adjusted as a result. On the other hand, the shoelace fastening device may be closed, and thus the shoelaces introduced into the shoelace fastening device may be firmly fastened.

In this case, a first through-hole 13 and a second through-hole 14 allowing shoelaces to run through are separately defined on the first buckle 10. Accordingly, the second buckle 20 includes a first pressing portion 22 and a second pressing portion 23 which respectively adapted to the first through-hole 13 and the second through-hole 14 provided thereon.

As is well known, a shoe has two shoelaces. Therefore, when using the shoelace fastening device, one shoelace enters the shoelace fastening device from the first through-hole 13, and extends out of the shoelace fastening device from the second through-hole 14; while the other shoelace enters the shoelace fastening device from the second through-hole 14, and extends out of the shoelace fastening device from the first through-hole 13. That is to say, two shoelaces of a shoe enter the shoelace fastening device from different through-holes.

After that, the first pressing portion 22 is inserted into the first through-hole 13, while the second pressing portion 23 is inserted into the second through-hole 14. In this way, the second buckle 20 is engaged with the first buckle 10, and the shoelaces are firmly fastened since the forces applied to the shoelaces are in opposite directions.

Figure 4:
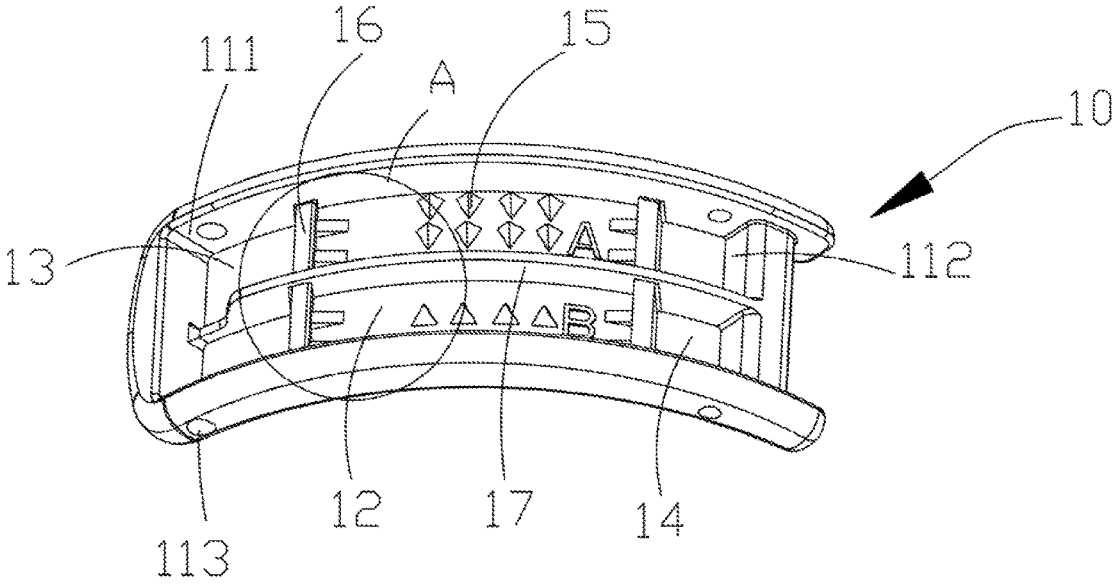
FIG. 4 is a schematic view of the first buckle show in FIG. 3.

Specifically, as shown in FIGS. 3-4, the first buckle 10 includes a frame 11 and a mounting plate 12 connected to the frame 11. The mounting plate 12 is fastened substantially in the middle of the frame 11. The mounting plate 12 has various auxiliary structures, such as projections or guiding portion, provided on an inner surface (facing towards the second buckle 20) thereof, in order to assist with the fastening of the shoelaces in the shoelace fastening device and to prevent the shoelaces from slipping out of the shoelace fastening device easily. A longitudinal length of the mounting plate 12 is shorter than that of the frame 11 in such a way that the first through-hole 13 and the second through-hole 14 are respectively formed between the mounting plate 12 and the frame 11.

In this case, as is shown in FIGS. 3-4, the frame 11 includes a pair of longitudinal walls 111 and a pair of transverse walls 112 which are connected respectively at two ends of the two longitudinal walls 111. The mounting plate 12 is connected between the pair of the longitudinal walls 111. Furthermore, a first axis hole 113 is defined on each of the longitudinal walls 111 at one end of the frame 11 that is close to the first through-hole 13.

Figure 7:
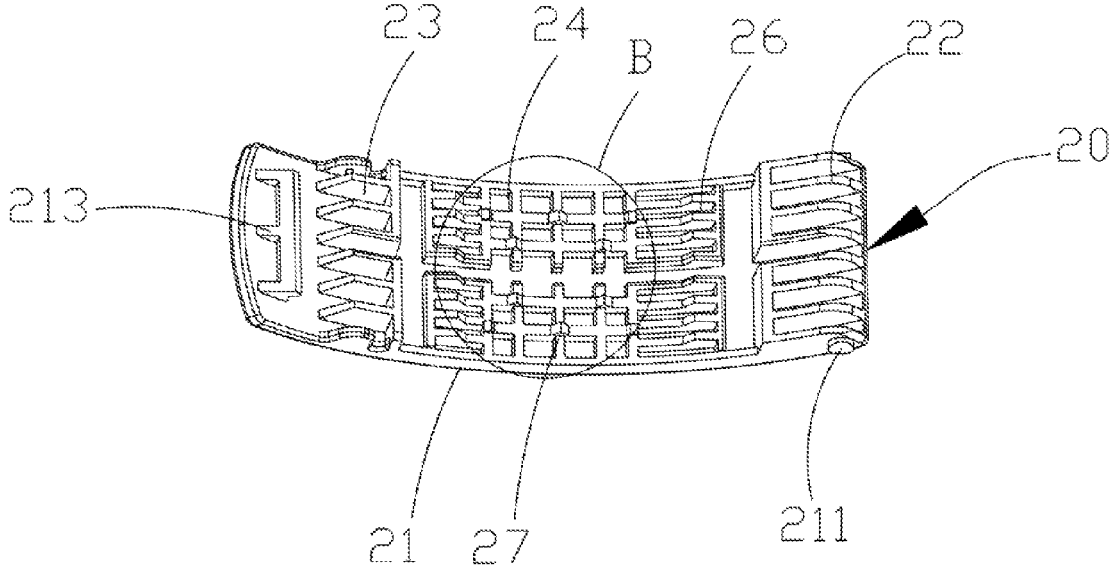
FIG. 7 is a schematic view of the second buckle show in FIG. 3.

As shown in FIG. 7, the second buckle 20 includes a main body 21; the first pressing portion 22 and the second pressing portion 23 are provided on an outer surface of the main body 21. A first pivot shaft 211 adapted to the first axis hole 113 is further provided on the main body 21 of the second buckle 20. The first pivot shaft 211 is inserted into the first axis hole 113, and thus the second buckle 20 is pivotably connected to the first buckle 10. Of course, in a further case, it is possible for the first pivot shaft to be provided on the frame 11 of the first buckle 10 and for the first axis hole to be defined in the second buckle 20.

Figure 6:
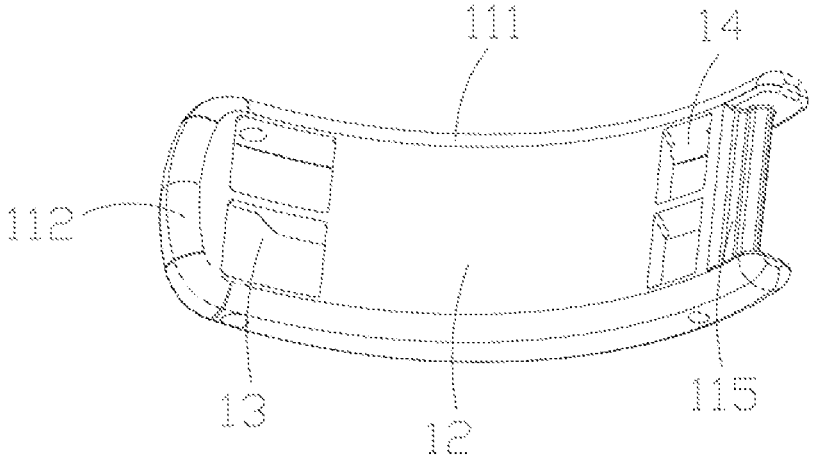
FIG. 6 is a further schematic view of the first buckle shown in FIG. 4.

As is shown in FIGS. 3-4 and 6, the first buckle 10 further includes a snapping slot 115 defined on an outer surface of the transverse wall 111 of the first buckle 10 at the other end of the frame 11 that is close to the second through-hole 14. Correspondingly, as is shown in FIG. 7, a snapping hook 213 adapted to the snapping slot 115 is provided on an inner surface of the main body 21 of the second buckle 20. The snapping hook 213 can be engaged with or disengaged from the snapping slot 115, and thereby the second buckle 20 can be engaged with or disengaged from the first buckle 10.

The snapping hook 213 is assisted with the fastening of the shoelaces, since a thickness of the shoelace fastening device will be increased when the shoelaces are introduced into the shoelace fastening device, and the second buckle 20 undergoes an upward pressure, which makes the snapping hook 213 slightly moves inwardly, and thus the shoelaces are firmly fastened. Furthermore, with the application of the snapping hook 213, the wearer can simply open the second buckle 20 by one hand.

Of course, in a further case, it is possible for the snapping hook to be provided on the first buckle 10, and for the snapping slot to be defined in the second buckle 20.

Specifically, as shown in FIGS. 3-4, a plurality of first projections 15 separated from each other are projected from the inner surface of the mounting plate 12 that is oriented towards the second buckle 20. In this case, the first projections 15 are substantially located in the middle of the mounting plate 12, and are divided into four rows in such a way that the shoelaces may be evenly supported. Furthermore, each of the first projections 15 is in shape of a triangular pyramid and has a shape corner in contact with the shoelace and for enhancing a friction coefficient between the first projection 15 and the shoelace.

Figure 8:
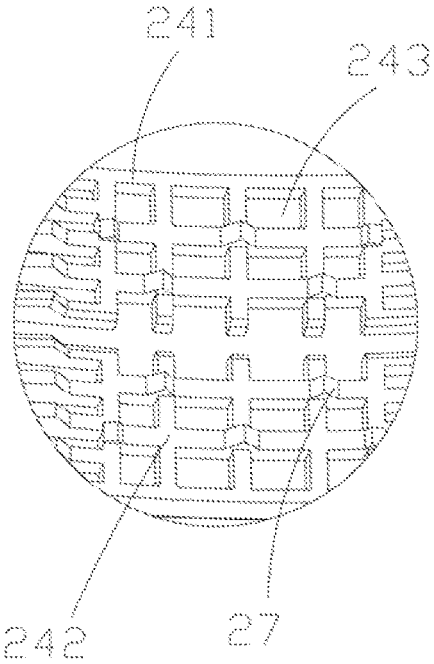
FIG. 8 is an enlarged view of part B of FIG. 7.

Correspondingly, as is shown in FIG. 7 and combing with FIG. 4, the second buckle 20 includes a receiving assembly 24 for receiving the first projections 15 of the first buckle 10. As is shown in FIGS. 7-8, the receiving assembly 24 includes a plurality of longitudinal ribs 241 separated from each other and a plurality of transverse ribs 242 intersecting with the plurality of longitudinal ribs 241. A plurality of receiving compartments 243 are formed by the longitudinal ribs 241 and the transverse ribs 242 intersecting with each other. The receiving compartments 243 are used for respectively receiving the first projections 15.

In this case, preferably, the transverse ribs 242 are perpendicular to the longitudinal ribs 241. Furthermore, the longitudinal ribs 241 are parallel to the longitudinal walls 111 of the first buckle 10, and are separately provided on the lower surface of the main body 21. The transverse ribs 242 are also separately provided on the lower surface of the main body 21.

In the case described above, the receiving assembly is provided on the second buckle 20, while the first projections are provided on the first buckle 10. However, it is also possible for the receiving assembly to be provided on the first buckle 10, and for the first projections to be provided on the second buckle 20.

Figure 5:
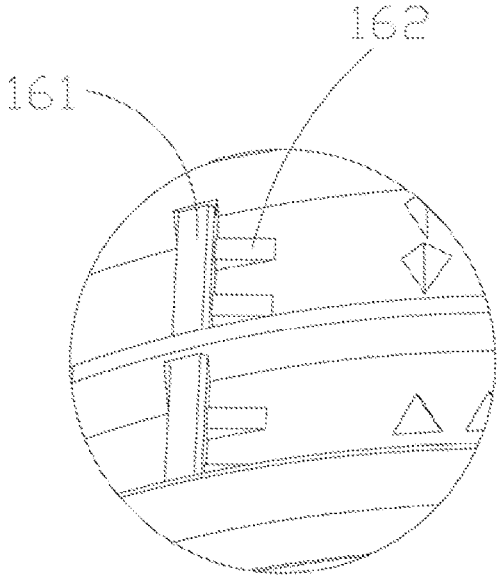
FIG. 5 is an enlarged view of part A of FIG. 4.

Moreover, two guiding portions 16 are symmetrically formed on two ends of the mounting plate 12 about a geometrical center of the mounting plate 12. In this case, as shown in FIGS. 4-5, the guiding portions 16 are arranged on the inner surface of the mounting plate 12. Each of the guiding portions 16 includes a guiding slope 161 and a plurality of guiding teeth 162 connected to the guiding slope 161. The guiding teeth 162 are inclined in a direction opposite to an inclining direction of the guiding slope 161. That is, if the guiding slope 161 has a positive slope, then the guiding teeth 162 have a negative slope; or vice versa. In this way, the shoelaces may be guided to enter the shoelace fastening device or to extend out of the shoelace fastening device from the guiding slope 161; or the shoelaces may be fastened in the middle portion of the shoelace fastening device due to the guiding teeth 162.

Furthermore, as is shown in FIG. 7 and combing with FIG. 4, two stressing portions 26 cooperated with the guiding portions 16 are provided on the inner surface of the main body 21 of the second buckle 20. When the second buckle 20 is engaged with the first buckle 10, the stressing portion 26 is used for cooperating with the guiding portion 16 and applying an extra stressing force to the shoelaces when the shoelaces run through the shoelace fastening device, in order to further fasten the shoelaces. The stressing portion 26 in this case is connected to a transverse rib at the outer side of the receiving assembly 24.

In addition, as is shown in FIG. 4, a separating wall 17 running through the mounting plate 12 is further connected between the pair of transverse walls 112. In this way, the first through-hole 13, the second through-hole 14 and the mounting plate 12 are divided into two parts for forming two separated running paths for two shoelaces. That is to say, each shoelace has its individual and separated running path. The running paths respectively of the two shoelaces will not mutually interfered, and the shoelaces will not overlapped in such a way that the whole thickness of the shoelace fastening device is controlled to make the shoelaces firmly positioned and fastened in the shoelace fastening device when the second buckle 20 is engaged with the first buckle 10.

Further, as shown in FIG. 1, an outer surface (the surface which is away from the mounting plate 12 of the first buckle 10) opposite to the inner surface of the main body is provided with a decorative portion 214. That is, the decorative portion 214 is provided on a surface which can be seen from outside. The decorative portion 214 is used for being printed or engraved with decorative patterns, such as LOGOs of a company, brands of the shoes or any other pattern. In this way, when adding the shoelace fastening device on a pair of shoes, the shoes will look much more attractive, and it is possible to show the brands of the shoes from the shoelace fastening device.

In addition, as is shown in FIG. 7, a plurality of second projections 27 are further projected from the longitudinal ribs 241 or the transverse ribs 242 of the receiving assembly 24. In this case, each of the second projections 27 is in shape of a triangular pyramid and has a shape corner in contact with the shoelace and for enhancing a friction coefficient between the first projection 15 and the shoelace.

Since the shoelace fastening device of the present application has a crescent shape, the shoelace fastening device of the present application can be both used in front of a shoe tongue or behind the shoe tongue, without hurting the feet of the wearer.

When using the shoelace fastening device of the present application to fasten the shoelaces, firstly the shoelace fastening device is put on a shoe. Then the second buckle 20 is disengaged from the first buckle 10. After that, one shoelace enters the shoelace fastening device from the first through-hole 13, extends across the mounting plate 12, and finally extends out of the shoelace fastening device from the second through-hole 14; while the other shoelace enters the shoelace fastening device from the second through-hole 14, extends across the mounting plate 12, and extends out of the shoelace fastening device from the first through-hole 13. After that, a tightness of the shoelace is adjusted as required. Once the wearer feels that the shoelaces are tight enough, the second buckle 20 is then pivoted in a direction towards the first buckle 10, and is finally engaged with the first buckle 10. Therefore, the shoelaces are secured and firmly fastened. When the wearer wants to adjust the tightness of the shoelaces, he only needs to open the second buckle 20 again (i.e., the second buckle 20 is disengaged from the first buckle 10). Therefore, the adjustment of the tightness of the shoelaces is simple and easy.

Besides, a decorative portion is provided on the upper surface of the main body 21 of the second buckle 20, and thus it is possible to print or engrave brands or patterns on the shoelace fastening device, which will make the appearance of the shoes more attractive. Therefore, the shoelace fastening device of the present application can be more widely used.

Although the present application is illustrated with the embodiments accompanying the drawings, however, it should be understood that, those skilled in the art may make many alternatives or equivalents, without going beyond the scope the claims intend to protect of the present application. Besides, many modifications may be made aiming at specific situation or materials, without going beyond the scope the claims intend to protect of the present application. Therefore, the present application is not limited to the specific embodiments disclosed herein, and the present application should include all the implementations fallen in the protection scope of the claims of the present application.

I claim:

1. A shoelace fastening device, comprising:

a first buckle, including:

a first through-hole, and a second through-hole separated from the first through-hole;

one shoelace of a shoe entering the shoelace fastening device from the first through-hole and extending out of the shoelace fastening device from the second through-hole, while the other shoelace entering the shoelace fastening device from the second through-hole and extending out of the shoelace fastening device from the first through-hole;

a second buckle, engaged with the first buckle or disengaged from the first buckle, one end of which pivotably connected to the first buckle; the second buckling having a first pressing portion adapted to the first through-hole and a second pressing portion adapted to the second through-hole;

wherein the first buckle includes a frame and a mounting plate connected to the frame; the first through-hole and the second through-hole are formed between the frame and the mounting plate; two guiding portions are formed on two ends of the mounting plate of the first buckle, and two stressing portion cooperated with the guiding portions are provided on the inner surface of the second buckle;

each of the two guiding portions includes a guiding slope and a plurality of guiding teeth connected to the guiding slope; the guiding teeth are inclined in a direction opposite to an inclining direction of the guiding slope.

2. The shoelace fastening device according to claim 1, wherein the first buckle includes a separating wall used for dividing the first through-hole and the second through-hole into two parts for forming two separated running paths for two shoelaces.

3. The shoelace fastening device according to claim 1, wherein the first buckle includes a snapping slot is defined on an outer surface at one end of the first buckle that is close to the second through-hole; a snapping hook adapted to the snapping slot is arranged correspondingly on the second buckle.

4. The shoelace fastening device according to claim 1, wherein a plurality of first projections separated from each other are projected from an inner surface of the mounting plate that is oriented towards the second buckle; a receiving assembly for receiving the plurality of first projections is formed on the inner surface of the second buckle;

wherein the receiving assembly includes a plurality of longitudinal ribs and a plurality of transverse ribs intersecting with the plurality of longitudinal ribs; a plurality of receiving compartments for respectively receiving the plurality of projections are formed by the longitudinal ribs and the transverse ribs.

5. The shoelace fastening device according to claim 4, wherein a plurality of second projections are further projected from the longitudinal ribs or the transverse ribs of the receiving assembly in a direction towards the first buckle.

6. The shoelace fastening device according to claim 5, wherein the first projections and the second projections are in shape of triangular pyramids.

7. The shoelace fastening device according to claim 1, wherein a decorative portion is provided on an outer surface of the second buckle.

8. The shoelace fastening device according to claim 1, wherein a first axis hole is defined at one end of the frame that is close to the first through-hole, and a first pivot shaft adapted to the first axis hole are correspondingly arranged on the second buckle.

9. The shoelace fastening device according to claim 1, wherein the shoelace fastening device is in shape of a crescent.

* * * * *